US008490345B2

(12) United States Patent
Fields

(10) Patent No.: US 8,490,345 B2
(45) Date of Patent: Jul. 23, 2013

(54) FRAMELESS WINDOW MODULE

(76) Inventor: Darell Wayne Fields, Cambridge, MA (US)

( * ) Notice: Subject to any disclaimer, the term of this patent is extended or adjusted under 35 U.S.C. 154(b) by 2330 days.

(21) Appl. No.: 10/255,058

(22) Filed: Sep. 13, 2002

(65) Prior Publication Data

US 2003/0051421 A1 Mar. 20, 2003

(51) Int. Cl.
*E06B 3/26* (2006.01)

(52) U.S. Cl.
USPC .... 52/202; 52/204.1; 52/204.593; 52/204.71; 49/62; 49/371

(58) Field of Classification Search
USPC ..... 52/202, 203, 204.1, 204.71, 171.3, 52/208, 204.593; 49/67, 68, 63, 62, 61, 371
See application file for complete search history.

(56) References Cited

U.S. PATENT DOCUMENTS

| | | | | | |
|---|---|---|---|---|---|
| 1,586,776 | A | * | 6/1926 | Warner | 49/155 |
| 2,000,366 | A | * | 5/1935 | Victor | 160/92 |
| 2,226,274 | A | * | 12/1940 | Winship | 49/65 |
| 2,286,899 | A | * | 6/1942 | Crescentini | 160/37 |
| 2,434,859 | A | * | 1/1948 | McLoughlin | 160/92 |
| 2,519,998 | A | * | 8/1950 | Burns | 160/329 |
| 2,583,627 | A | * | 1/1952 | Burns | 160/327 |
| 3,357,136 | A | | 12/1967 | Marantier | |
| 3,631,629 | A | * | 1/1972 | Bercheux | 49/256 |
| 3,660,940 | A | * | 5/1972 | Tavano | 49/366 |
| 3,676,955 | A | * | 7/1972 | Schacht | 49/192 |
| 3,791,074 | A | * | 2/1974 | Waffenschmidt | 49/399 |
| 3,961,821 | A | | 6/1976 | Mistopoulos, Jr. | |
| 4,004,629 | A | | 1/1977 | Kelly | |
| 4,248,018 | A | | 2/1981 | Casamayor | |
| 4,637,299 | A | | 1/1987 | Harding | |
| 4,817,354 | A | * | 4/1989 | Bayer | 52/302.7 |
| 4,875,308 | A | | 10/1989 | Peetz et al. | |
| 5,116,274 | A | | 5/1992 | Artwohl et al. | |
| 5,400,557 | A | * | 3/1995 | Glover | 52/201 |
| 5,483,770 | A | | 1/1996 | Marinoni | |
| 5,533,314 | A | * | 7/1996 | Kunert | 52/788.1 |
| 5,737,885 | A | | 4/1998 | Stoyke | |
| 5,806,256 | A | | 9/1998 | Byrne | |
| 5,832,666 | A | * | 11/1998 | Flack et al. | 49/67 |
| 5,937,611 | A | | 8/1999 | Howes | |
| 6,155,009 | A | | 12/2000 | Pena | |
| 6,244,778 | B1 | | 6/2001 | Chesbrough | |
| 6,378,248 | B1 | * | 4/2002 | Jordal | 49/80.1 |
| 6,412,225 | B1 | * | 7/2002 | McManus | 52/208 |
| 6,519,903 | B1 | * | 2/2003 | Dirisamer et al. | 52/235 |
| 6,823,626 | B2 | * | 11/2004 | Kinsey | 49/187 |

FOREIGN PATENT DOCUMENTS

| | | | |
|---|---|---|---|
| WO | WO 98/01648 | * | 7/1997 |

* cited by examiner

*Primary Examiner* — Joshua J Michener
*Assistant Examiner* — Chi Q Nguyen
(74) *Attorney, Agent, or Firm* — Albert Peter Durigon

(57) ABSTRACT

A frameless window module allows operable windows to be placed in any location of a wood stud frame wall without compromising the load bearing capability of the studs thereof. By using lift-off pivot hinges, two (2) panes of glass are respectively pivotally mounted to the exterior and interior surfaces of the wood stud frame wall. Pneumatic gaskets enable to controllably regulate the air interspace captured thereby to provide a variable-insulation aperture. Interconnection hinges cause the two (2) glass panes of a module to move in concert and/or serve to securely lock them in their closed position.

14 Claims, 14 Drawing Sheets

FRAMELESS WINDOW MODULE

FIELD OF THE INVENTION

This invention is drawn to the field of movable closures, and more particularly, to a novel frameless window module.

BACKGROUND OF THE INVENTION

Wood stud frame walls of buildings or other structures include a longitudinally-extending cap piece at the top (typically two 2 by 4's), a longitudinally-extending sole plate at the bottom (typically one 2 by 4), and a continuous run of upstanding studs (typically 2 by 4's) interconnecting the cap piece and sole plate. Such walls are typically used in modular or prefab construction, new "on-site" construction and/or in the walls of already-existing homes or other buildings or structures.

A portion of one or more studs is usually cut-out of the wood stud frame to provide an opening thereinthrough to receive a window. The portion remaining above the opening of the one or more studs that have been cut is no longer capable of bearing loads, and a longitudinally-extending header (typically two 2 by 6's or 2 by 8's), connected thereto and to the longitudinally-adjacent uncut studs, is employed to distribute the load to the adjacent studs. A longitudinally-extending bottom piece (typically two 2 by 4's) is connected to the portion of the one or more cut studs remaining below the opening and to the longitudinally-adjacent uncut studs.

A window box is mounted in the opening provided by the header and bottom piece at each location in the wood stud frame wall where window receiving openings have been provided. Typically, the window box includes a casing by which it is attached to the wood stud frame wall when it is mounted in the opening, and a sash, sill and weather-stripping; one or more shims may be employed between the bottom piece and the window box to provide proper alignment.

Not only is the load bearing capability of the studs impaired and structural modifications to the frame required to provide support for each opening that receives a window box, but also, once a window box is inserted into an opening, the natural insulation properties of the wood stud frame wall are lost and there is heat loss between the window box/support interface.

SUMMARY OF THE INVENTION

Accordingly, it is one object of the present invention to disclose a frameless window module providing operable windows of any length in a wood stud frame wall without compromising the studs' load bearing capability.

It is another object of the present invention to disclose a frameless window module that utilizes the natural insulation properties of a wood stud frame wall to provide insulation.

It is a further object of the present invention to disclose a frameless window module that utilizes and controls the natural insulation properties of a wood stud frame wall to provide a variable-insulation aperture.

It is another object of the present invention to disclose a frameless window module providing operable windows in modular construction wood stud frame walls, new "on-site" construction wood stud frame walls and in already-existing walls of wood stud frame construction.

In accord therewith, and in broad terms, the present invention contemplates a frameless window module for a wood stud frame wall having opposing interior and exterior surfaces and a continuous run of studs, that includes a pair of glazing members each adapted for exterior mounting to opposing sides of the wood stud frame wall for motion between open and closed positions. When both glazing members of a module are moved to their open positions, an opening (for ventilation or viewing) is provided through the wood stud frame wall that is interrupted by the number of included studs of the continuous run of studs thereof, and when both glazing members of a module are moved to their closed positions, insulation is provided by the air interspace between the included studs captured therebetween. Operable windows of any length may be provided in modular construction, new "on-site" construction and in already-existing walls of wood stud frame construction in dependence on the number of modules arrayed.

The glazing members of the pair of glazing members of the frameless window module of the present invention each preferably include a pivot hinge subassembly adapted for exterior mounting to a corresponding one of the opposing interior and exterior surfaces of the wood stud frame wall, preferably a lift-off pivot hinge subassembly, for mounting that glazing member for pivoting motion towards and away from the corresponding one of the opposing interior and exterior surfaces of the wood stud frame wall. Although pivot hinges are preferred and lift-off pivot hinge subassemblies are easy to construct, allow pop-in and removal of each glazing member without the need for fasteners and are easy to maintain and to replace, any mechanism adapted for exterior mounting to opposing sides of the wood stud frame wall for motion between open and closed positions could be employed without departing from the inventive concepts.

An interconnection hinge subassembly coupled to each glazing member of the pair of glazing members is responsive to the pivoting motion of one glazing member towards and away from the corresponding one of the interior and external surfaces of the wood stud frame wall to cause pivoting motion of the other glazing member towards and away from the other one of the opposing interior and exterior surfaces of the wood stud frame wall. In this manner, the glazing members of a frameless window module in accord with the present invention move together in concert in a "butterfly" fashion between their open and closed positions. The interconnection hinge subassembly may be adapted to apply compressive pressure that securely locks the glazing member pivotally mounted to the exterior surface in its closed position.

Seals and cooperative seal-seats seal the lateral and longitudinal edges of the one or more frameless window modules when the glazing members thereof are in closed position to provide insulation. The seals may be of felt, neoprene or magnetic or other material. Pneumatic gaskets (and cooperative gas manifold and controller) may be employed for controlling the degree of seal of one or more frameless window modules when the glazing members thereof are in closed position to provide one or more variable-insulation apertures.

In one presently preferred embodiment, each glazing member includes a first glass pane adhesively laminated in laterally offset relation to a second glass pane defining flanges to either side thereof, and edge plates adhesively mounted to each of the flanges. A strip seal, and strip seal and closure hardware, are respectively mounted to one of the edge plates, and pivot rods and one or more interconnection hinges, are mounted to the other edge plates of each module. End terminations are provided for end (or single) frameless window modules. In another presently preferred embodiment, each glazing member of a module is constituted by a single glass pane, mounted in a generally rectangular sash that is pivotally mounted to a casement, which, in turn, is adapted for exterior mounting to the wood stud frame wall.

In another embodiment of the frameless window module of the present invention, only a single glazing member adapted for exterior mounting to the exterior surface of the wood stud frame wall for pivoting motion between open and closed positions may be employed to provide egress in emergency or other situations.

The principles of the present invention have application to frameless integument modules in general, such as doors, awnings and the like.

BRIEF DESCRIPTION OF THE DRAWINGS

These and other objects, inventive aspects and advantageous features of the frameless window module of the present invention will become apparent as the invention becomes better understood by referring to the following, solely exemplary, detailed description of the presently preferred embodiments, and to the drawings, wherein.

DETAILED DESCRIPTION OF THE PRESENTLY PREFERRED EMBODIMENTS

Figure 1:
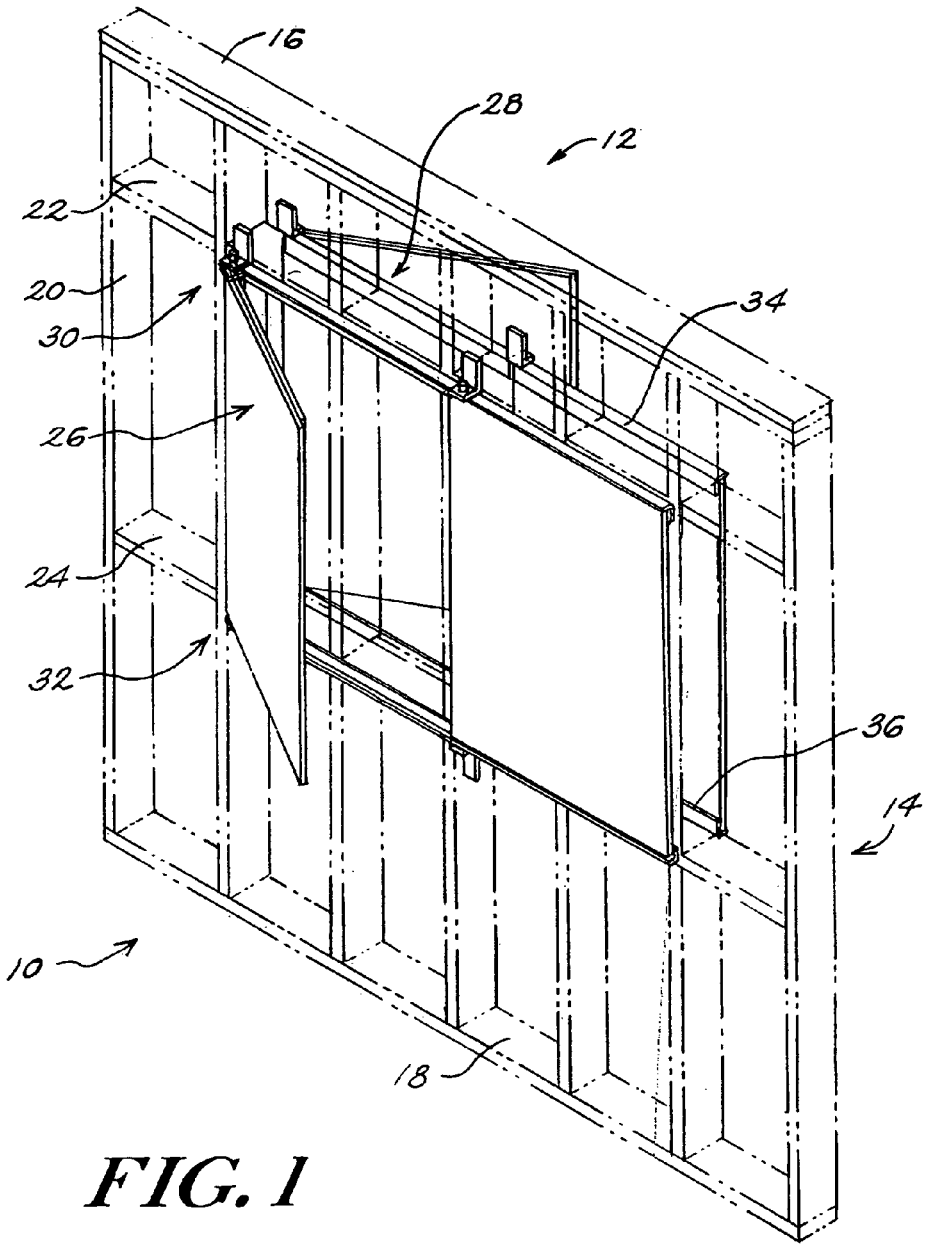
FIG. 1 is a perspective view illustrating two (2) frameless window modules exteriorly mounted to opposing sides of a wood stud frame wall of one presently preferred embodiment in accord with the present invention.

Referring now to FIG. 1, generally designated at 10 is a perspective view illustrating two (2) frameless window modules generally designated 12 exteriorly mounted to a wood stud frame wall generally designated 14 that is illustrated in dashed outline of one presently preferred embodiment in accord with the present invention. The wood stud frame wall 14 includes a cap piece 16, sole plate 18 and a continuous run of laterally-spaced upright studs 20 connected between the cap piece 16 and sole plate 18. To the wood stud frame wall 14 framing members 22, 24 are attached. While two (2) frameless window modules 12 are specifically illustrated in a prefabricated wood stud frame wall 14, it will be appreciated that one (1) or more such modules may be employed to provide operable windows of any length in dependence on the number of arrayed modules in prefabricated, new "on-site" construction and through walls of already-existing wood stud frame construction without impairing the load bearing capability of the continuous run of the studs thereof.

Each frameless window module 12 includes a pair of glazing members generally designated 26, 28 to be described adapted for exterior mounting to opposing sides of the wood stud frame wall 14 for motion between open and closed positions. In their open positions illustrated, an opening (for ventilation or viewing) is provided through the wood stud frame wall 14 that is defined by the framing members 22, 24 and boundary studs, and that is interrupted by the included stud(s) of the continuous run of studs 20. As will readily be appreciated, boundary studs may need attachment for new "on-site" construction, and boundary studs and/or framing members may need attachment for already-existing wood stud frame walls, depending on the specific location and wall configuration of each actual application environment. In their closed positions illustrated, the air of the interspace between the headers and boundary and included studs captured therebetween provides insulation. As in other embodiments herein described, weep holes, not shown, are provided between laterally adjacent modules to allow air pressure equalization within the wall cavity to be distributed throughout the window/wall assembly. This produces an insulating air plenum that has the added benefit of preventing condensation. As appears more fully below, the insulating airspace may be regulated in a manner to be described to provide a variable-insulation aperture.

Each glazing member 26, 28 is of a laminated construction to be described exteriorly mounted to the wood stud frame wall 14 by upper and lower pivot hinges generally designated 30, 32 to be described for pivoting motion towards and away from a corresponding one of the opposing sides of the wood stud frame wall 14 between closed and open positions. Although laminated glazing members adapted for exterior mounting to opposing exterior surfaces for pivoting motion are presently preferred, it will be appreciated that glazing members of the same or of another configuration adapted for exterior mounting to opposing sides of a wood stud frame wall for pivoting motion between open and closed positions may be employed without departing from the inventive concepts.

Figure 2:
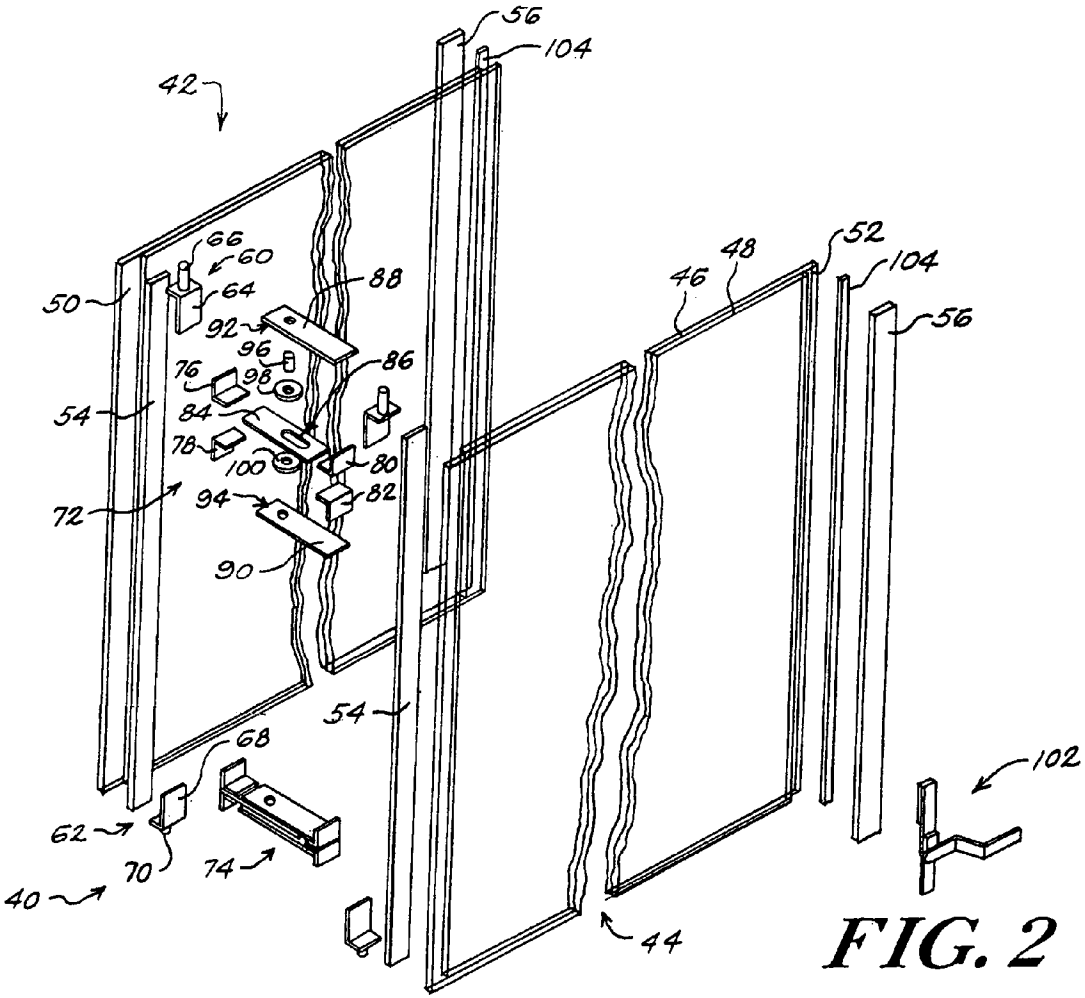
FIG. 2 is an exploded perspective view of the frameless window module of FIG. 1.

Referring now briefly to FIG. 2, generally designated at 40 is an exploded perspective view of the frameless window module of the FIG. 1 embodiment in accord with the present invention. The frameless window module 40 includes a pair of laminated glazing members generally designated 42, 44. Each laminated glazing member 42, 44 consists of a glass pane 46 adhesively or otherwise laminated in laterally offset relation with a glass pane 48 defining flanges 50, 52 at the opposing ends thereof. Metallic or other material edge plates 54, 56 are adhesively or otherwise attached to the flanges 50, 52 of each laminated glazing member 42, 44.

Upper and lower pivot hinges generally designated 60, 62 are threadably or otherwise fastened to the edge plates 54 of each glazing member 42, 44. The upper pivot hinges 60 include an angle bracket 64 supporting a comparatively-longer pivot rod 66, and the lower pivot hinges 62 include an angle bracket 68 supporting a comparatively-shorter pivot rod 70. The pivot rods 66, 70 of the upper and lower hinges 60, 62, together with rotary bearings provided by upper and lower angle brackets exteriorly mounted to the wood stud frame wall, not shown, provide lift-off pivot hinges.

A pair of upper and lower interconnection hinges generally designated 72, 74 are threadably or otherwise fastened to the edge strips 54 of each glazing member 42, 44 of the frameless window module 40. Each of the interconnection hinges 72, 74 includes a pair of angle brackets 76, 78 threadably or otherwise fastened to the edge strip 54 of the glazing member 42 and a pair of angle brackets 80, 82 threadably or otherwise fastened to the edge strip 54 of the glazing member 44. A plate 84 having an elongated slot generally designated 86 is threadably or otherwise attached between the angle brackets 76, 78, and a pair of plates 88, 90 having aligned openings generally designated 92, 94 are threadably or otherwise fastened respectively to the angle brackets 80, 82, with the plate 84 captured between the plates 88, 90 of each of the interconnection hinges 72, 74. A pin 96 is passed through the openings 92, 94 of the plates 88, 90 and slot 86 of the plate 84. An insulating washer 98 is provided around the pin 96 between the plate 88 and the plate 84, and an insulating washer 100 is provided around the pin 96 between the plate 90 and the plate 84 of each of the interconnection 72, 74.

In operation of the interconnection hinges 72, 74, whenever window locking hardware generally designated 102 is unlocked and the glazing member 44 is pivotally moved on the pair of upper and lower pivot hinges 60, 62, the interconnection hinges 72, 74 respond to the pivoting motion of the glazing member 44 to cause the glazing member 42 to pivotally move in concert therewith. As the glazing member 44 is pivotally moved, the pin 96 carried by the aligned apertures 92, 94 of the plates 88, 90 of each interconnection hinge 72, 74 traces an arc, which, because it is captured in the elongated slot 86 of the plate 84 of each interconnection hinge 72, 74, causes the glazing member 42 to pivotally move in concert therewith in "butterfly" fashion. The insulating washers 98, 100 help prevent thermal conduction through the interconnection hinges 72, 74.

Although interconnection hinges are presently preferred, it will be appreciated that any means responsive to pivoting motion of one glazing member to cause the other glazing member of a module to pivotally move in concert (in- or out-of-phase) therewith could be employed without departing from the inventive concepts.

Figure 3:
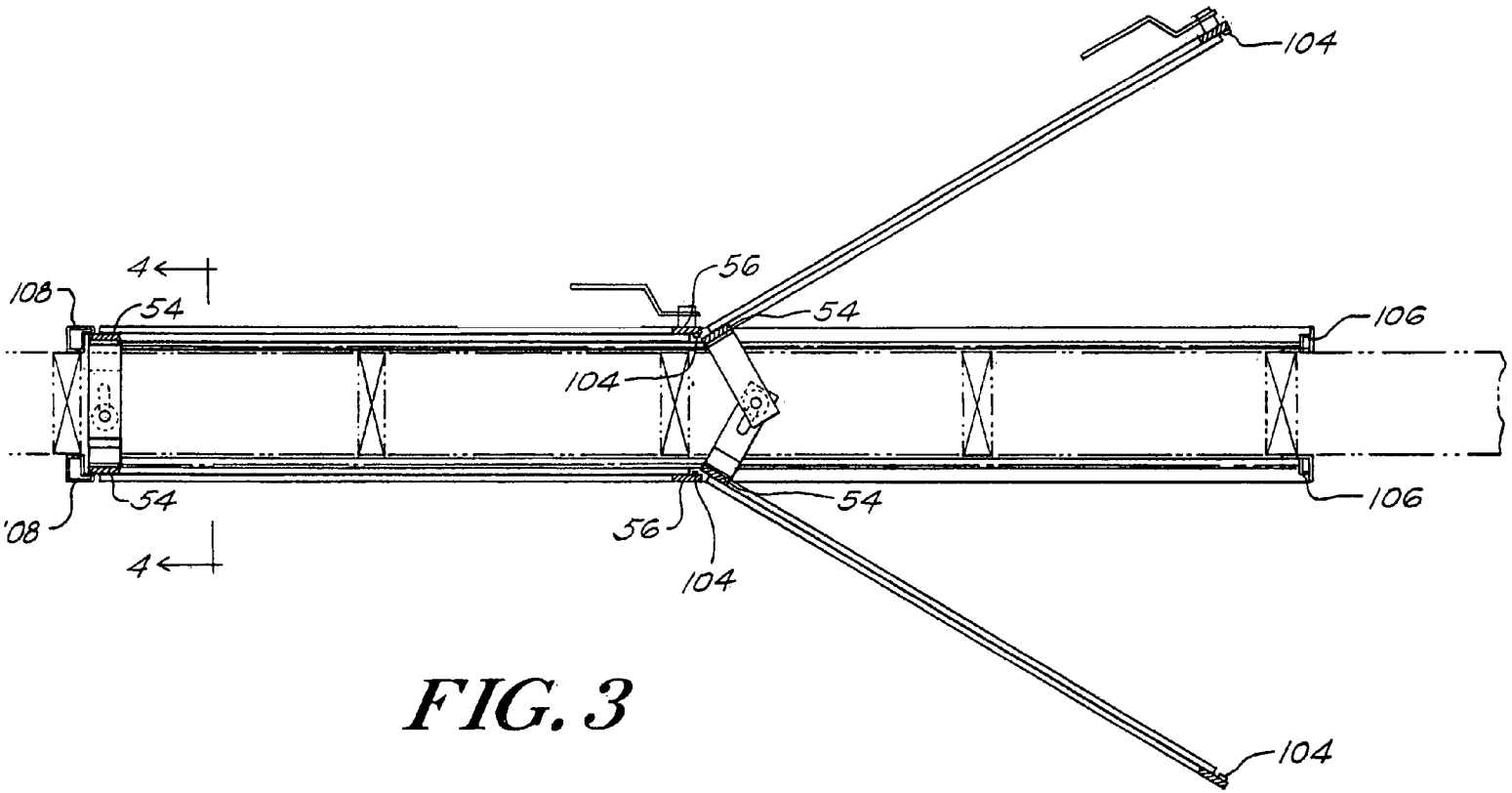
FIG. 3 is a top plan view taken along the lines 3-3 of FIG. 4 illustrating two (2) frameless window modules of the FIG. 1 embodiment exteriorly mounted to opposing sides of a wood stud frame wall.

The window locking hardware 102, that may be of any suitable configuration, is mounted to the edge strip 56 of the glazing member 44, and seal gaskets 104 are adhesively or otherwise fastened to the edge plates 56 of each of the glazing members 42, 44 of the frameless window module 40. As shown in FIG. 3, the seal gaskets 104 attached to the edge plates 56 of one frameless window module seat against the flanges of the edge plates 54 of a longitudinally adjacent frameless window module to seal longitudinally adjacent edges of intermediate frameless window modules and seat against end terminations 106 exteriorly mounted to the wood stud frame wall of end (or single) frameless window modules, while the flanges of the edge plates 54 of end (or single) frameless window modules provide a seat for a seal, not shown, carried by end terminations 108 exteriorly mounted to the wood stud frame wall of end (or single) frameless window modules. While seal gaskets and flange seats for intermediate modules and seal gaskets and end terminations for end (or single) modules are presently preferred, any means for sealing the edges of longitudinally adjacent modules and the edges of end (or single) modules when the pair of glazing members of each of one or more frameless window modules is in closed position may be employed without departing from the inventive concepts.

Figure 4:
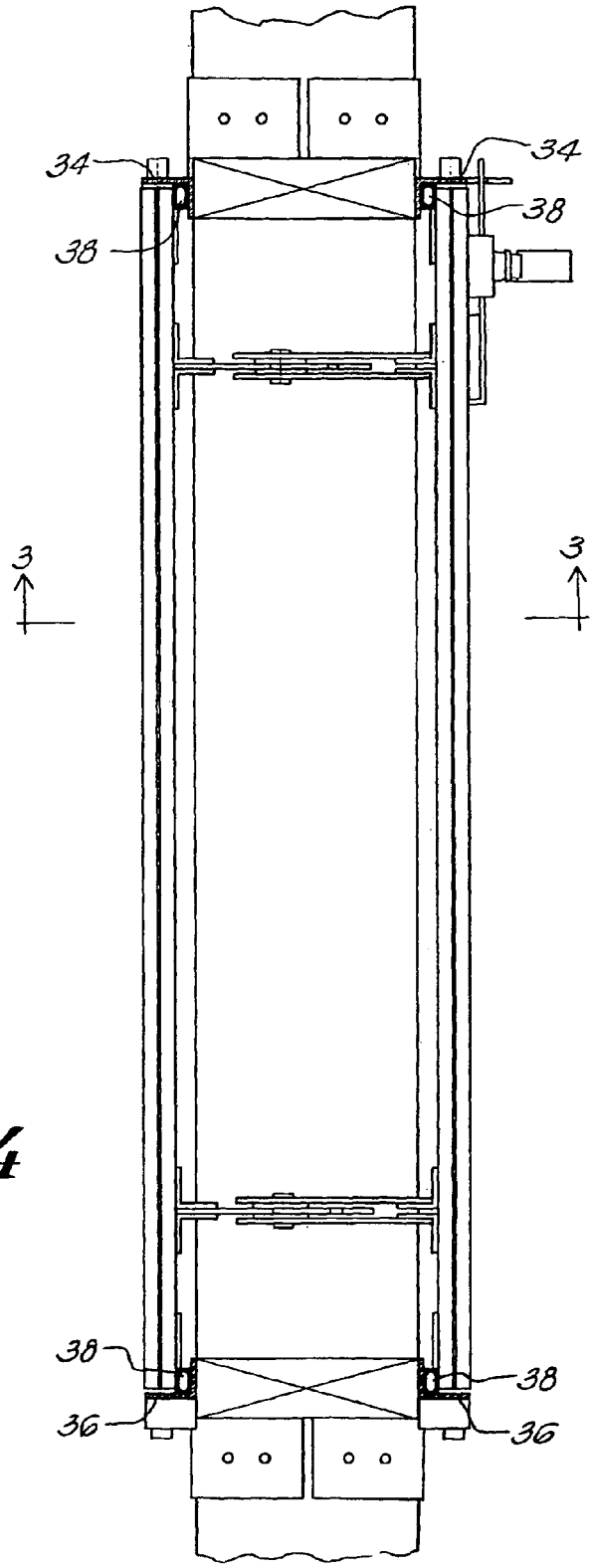
FIG. 4 is a side sectional view taken along the lines 4-4 of FIG. 3.

Returning now to FIG. 1, upper and lower angle brackets 34, 36 are mounted to the framing members 22, 24 on the opposing sides of the wood stud frame wall 14. The angle brackets 34, 36 may continuously extend past several frameless window modules, or may be attached piecewise, one upper and lower pair for each glazing member of each frameless window module. As shown in FIG. 4, a pneumatic gasket 38 is adhesively or otherwise fastened to each of the angle brackets 34, 36 that seats against the upper and lower edges of each glazing member of the pair of glazing members of a frameless window module thereby sealing the same when in closed position. Although pneumatic gaskets and angle brackets for sealing the longitudinal edges of each of the glazing members of a pair of glazing members of a frameless window module are presently preferred, any suitable means, such as fixed gaskets or fixed gaskets with weep holes, could be employed without departing from the inventive concepts.

Figure 5:
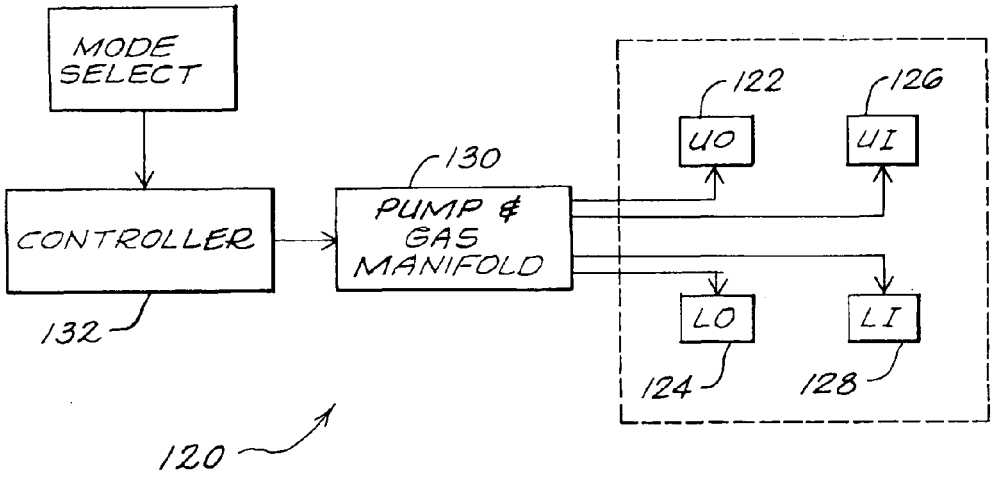
FIG. 5 is a schematic diagram useful in explaining how a frameless window module in accord with the present invention is operable to provide a variable-insulation aperture.

Referring now to FIG. 5, generally designated at 120 is a schematic diagram useful in explaining how the frameless window module of the present invention is operable to provide a variable-insulation aperture. Four (4) pneumatic gaskets 122, 124, 126, and 128 respectively marked UO, LO, UI, LI for "upper outer," "lower outer," "upper inner," and "lower inner," are connected to an air pump and gas manifold 130. A controller 132 is connected to the air pump and manifold 130. In different modes, the controller 132 is operable to controllably vary the air pressure supplied to each of the pneumatic gaskets 122, 124, 126 and 128. For example, when it is desired to fully utilize the air interspace for insulation, the controller 132 is operative to supply full-pressure to each of the pneumatic gaskets 122, 124, 126 and 128 via the air pump and gas manifold 130. Or, for example, when it is colder outside than inside and it is desired to enjoy fresh air without substantial heat loss, the controller 132 is operative to supply full-pressure to the upper outer and lower inner pneumatic gaskets 122, 128 while supplying partial-pressure to the lower outer and upper inner pneumatic gaskets 124, 126. In this manner, cold, fresh air entering through the lower outer gasket 124 mixes with the air in the interspace, thereby gaining heat, and fresh, warmed air passes into the interior through the upper inner pneumatic gasket 126. While controller-implemented regulation of air pressure to pneumatic gaskets is presently preferred, any suitable means for controlling the natural insulation properties of a wood stud frame wall to provide a variable-insulation aperture may be employed without departing from the inventive concepts.

Figure 6:
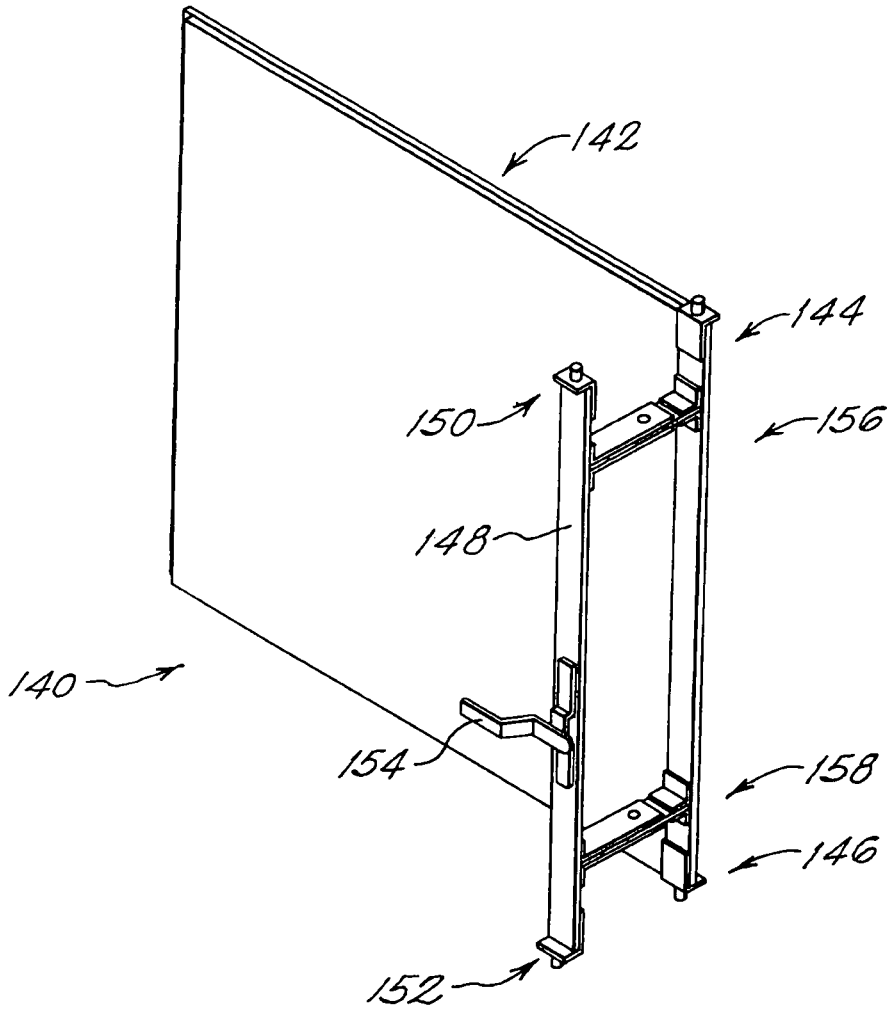
FIG. 6 is a perspective view of another embodiment of a frameless window module in accord with the present invention useful to provide egress in emergency or other situations.

Referring now to FIG. 6, generally designated at 140 is a perspective view of another embodiment of a frameless window module in accord with the present invention useful to provide egress in emergency or other situations. The module 140 includes a single laminated glazing member generally designated 142 adapted for pivoting motion to the exterior surface of a wood stud frame wall, not shown, on lift-off pivot hinges generally designated 144, 146, and a plate 148 adapted for pivoting motion to the interior surface of the wood stud frame wall, not shown, on lift-off pivot hinges generally designated 150, 152. A handle 154 is provided on the plate 148. Hinges generally designated 156, 158 interconnect the plate 148 and the single laminated glazing member 142. The glazing member 142, lift-off pivot hinges 144, 146, 150, 152 and the interconnection hinges 156, 158 are the same as those described above and are not described again for the sake of brevity of explication. Any suitable glazing member adapted for exterior mounting for motion between open and closed positions to provide egress in emergency or other situations could be employed without departing from the inventive concepts.

In operation, when the handle 154 is used to pivot the plate 148 inwardly, the motion thereof is communicated through the interconnection hinges 156, 158 to the single glazing member 142, which pivotally moves in concert therewith.

Frameless window modules in accord with the present invention may be provided for installation in new "on-site" construction or in already-existing walls of wood stud frame construction, or may be provided already installed in modular or prefabricated walls of wood stud frame construction, without departing from the inventive concepts.

Figure 7:
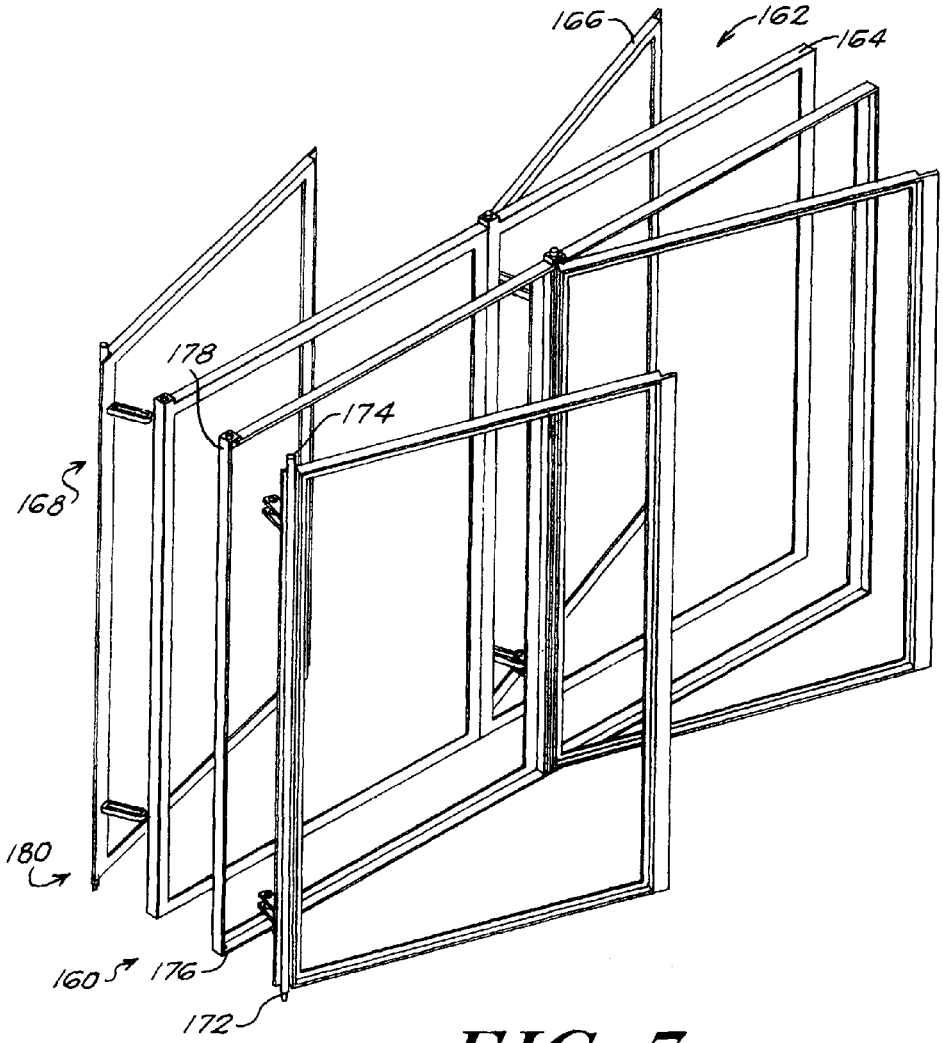
FIG. 7 is an exploded perspective view illustrating the sash and casement of two (2) frameless window modules of another presently preferred embodiment in accord with the present invention.

Referring now to FIG. 7, generally designated at 160 is an exploded perspective view illustrating the sash and casement of two (2) frameless window modules generally designated 162 of another presently preferred embodiment in accord with the present invention. While two (2) frameless window modules 162 are specifically illustrated, it will be appreciated that one (1) or more such modules may be deployed to provide operable windows of any length in wood stud frame walls in dependence on the number of arrayed modules.

Figure 8:
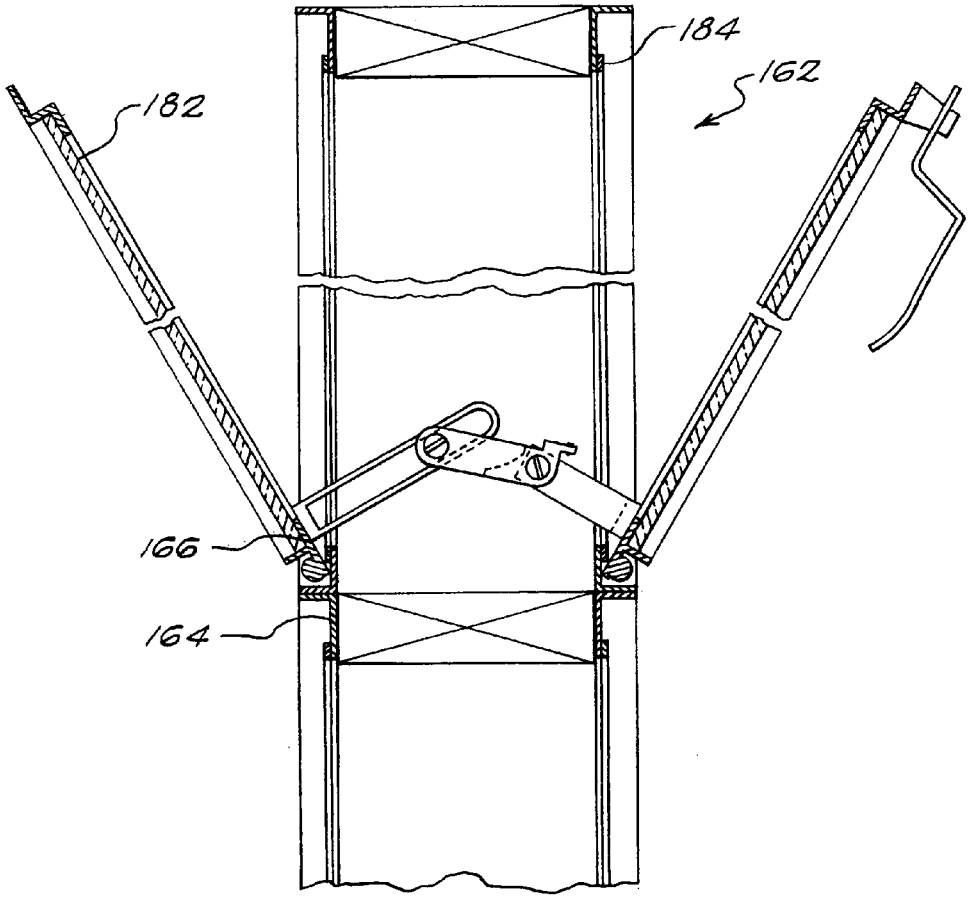
FIG. 8 is a longitudinal sectional view illustrating two (2) frameless window modules of the FIG. 7 embodiment exteriorly mounted to opposing sides of a wood stud frame wall showing one of the modules in its open position.
Figure 9:
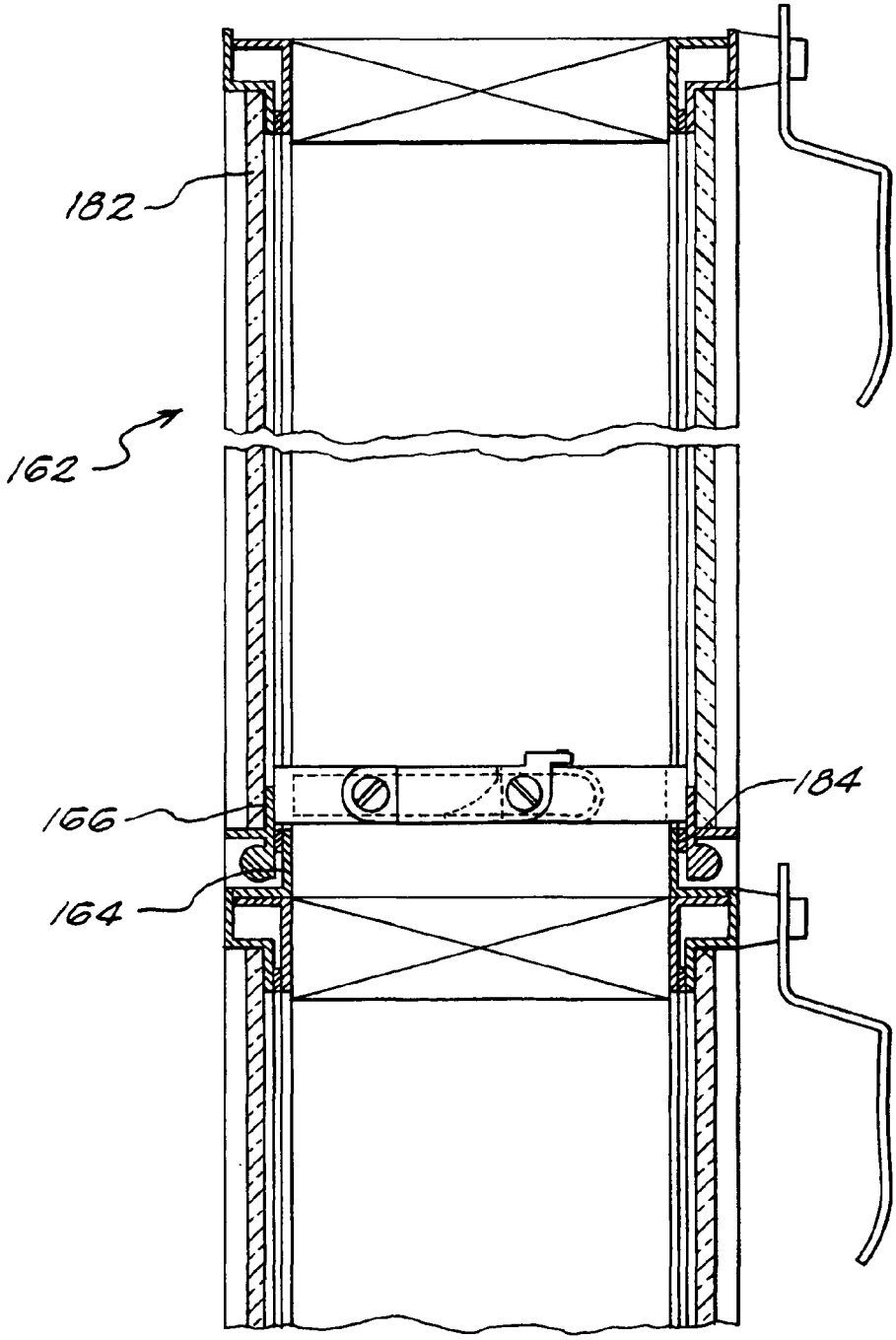
FIG. 9 is a longitudinal sectional view illustrating two (2) frameless window modules of the FIG. 7 embodiment exteriorly mounted to opposing sides of a wood stud frame wall showing the modules in their closed position.

Each frameless window module 162 includes a generally rectangular casement 164 adapted for exterior mounting to opposing sides of a wood stud frame wall, not shown, and a generally rectangular sash 166 mounted to the casement 164 for pivoting motion between open and closed positions via a lift-off pivot hinge subassembly generally designated 168. The lift-off pivot hinge subassembly of each module includes pivots 172, 174 provided on the sash 166 and pivot races 176, 178 provided on the casement 164. The race 178 of each lift-off pivot hinge subassembly is spaced above the casement 164 a distance larger than the extension of the pivot 172. To insert a sash into its casement, pivot 174 is inserted in race 178, the sash is lifted up through the offset provided by the race 178, and then lowered to seat pivot 172 in its race 176 (the process is reversed for removal, not separately described herein for the sake of brevity of explication). An interconnection hinge subassembly generally designated 180 to be described attached to the sashes of each frameless window module is adapted to cause the glazing members of each module to move in concert in a "butterfly" manner between open and closed positions respectively illustrated in FIGS. 8 and 9. A single pane of glass 182, shown in FIGS. 8 and 9, is mounted in the generally rectangular sashes 166 of each module 162. The lateral edges of the sashes 166 of each module define seal seats, and seals 184, shown in FIGS. 8 and 9, are provided therefor on the confronting faces of the casement 164 of each module. The longitudinal edges of the sashes 166 of each module likewise define seal seats, and seals, not shown, are provided therefor on the confronting faces of the casement 164 of each frameless window module. Any suitable means for sealing the lateral and longitudinal edges of the modules may be employed.

Figure 10A:
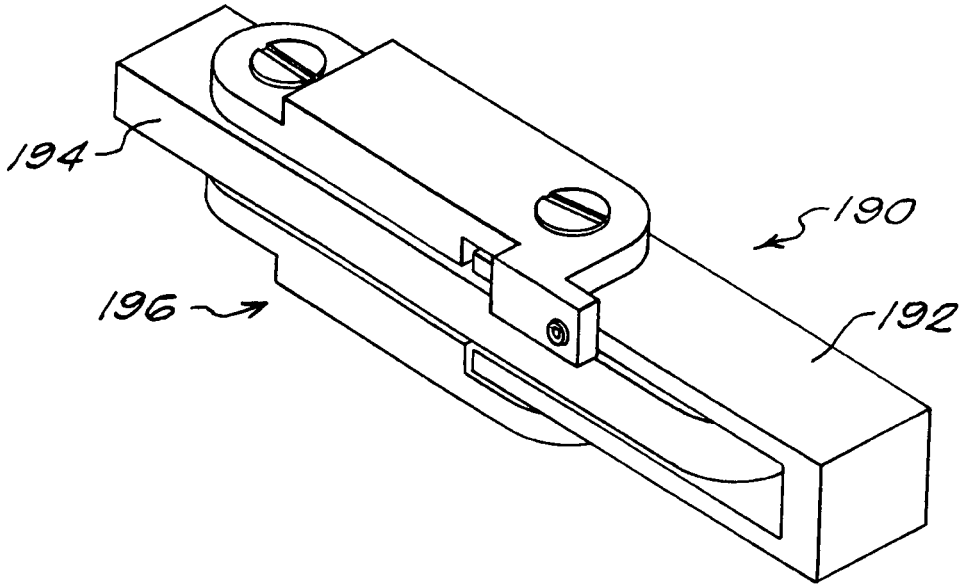
FIG. 10A is a perspective view and FIG. 10B an exploded perspective view illustrating the interconnection hinge adapted to securely lock glazing members in their closed position of the frameless window module in accord with the present invention.

Referring now to FIG. 10, interconnection hinge subassembly generally designated 190 includes a generally U-shaped member 192, a slotted member 194 and a link member having laterally spaced arms generally designated 196 connecting the members 192, 194. The arms of the link member 196 are pivotally attached to respective arms of the U-shaped member 192 via threaded attachment members 198, 200, and are attached to each other at their opposite ends via threaded attachment members 202, on which a rotary bushing 204 is mounted. The slotted member 194 is captured by the bushing 204 carried by the threaded attachment members 202. A flange 208 is carried by link member 196, and an adjustable screw 210 is turned into the flange 208.

Figure 10B:
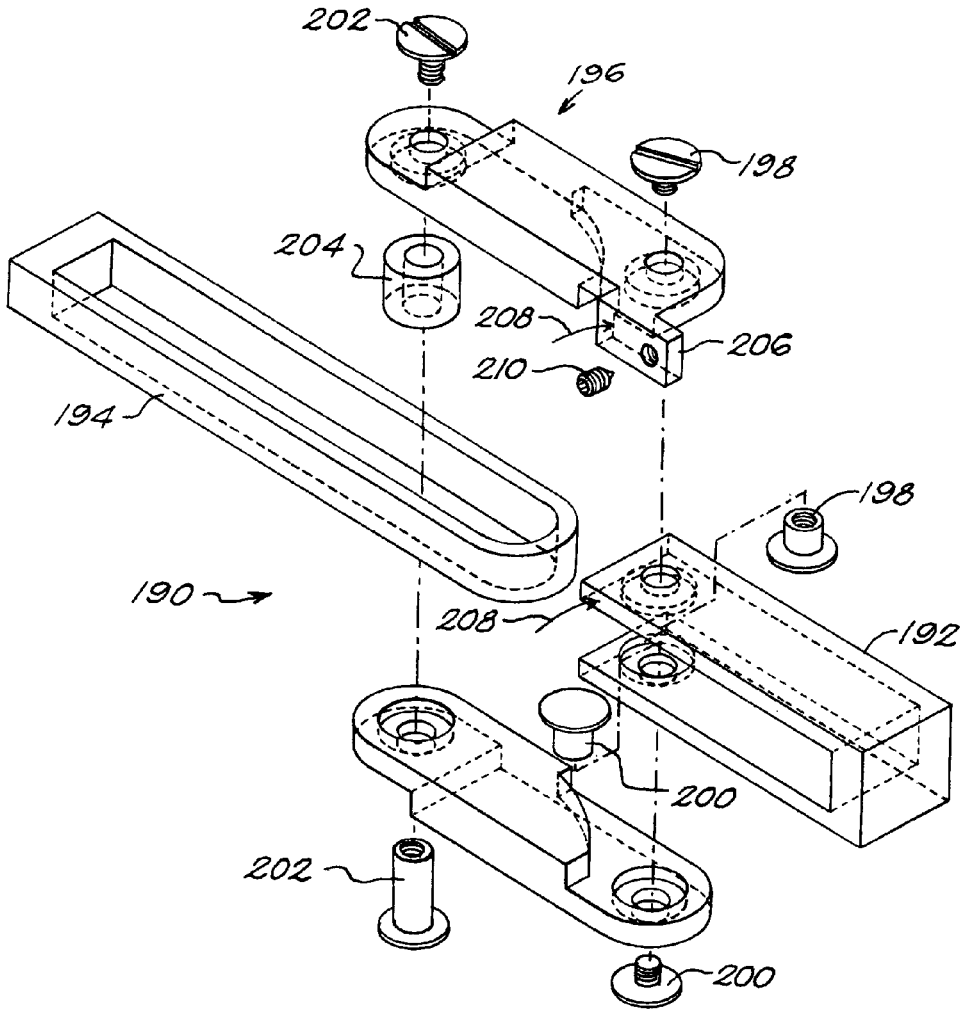
Figure 11A:
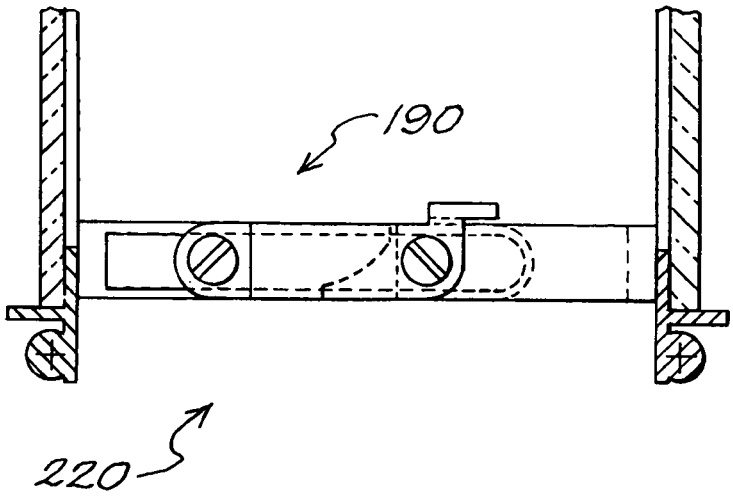
FIG. 11 in the FIGS. 11A-11E thereof are pictorial views useful in explaining how the interconnection hinge subassembly is operable to securely lock glazing members in their closed position.
Figure 11B:
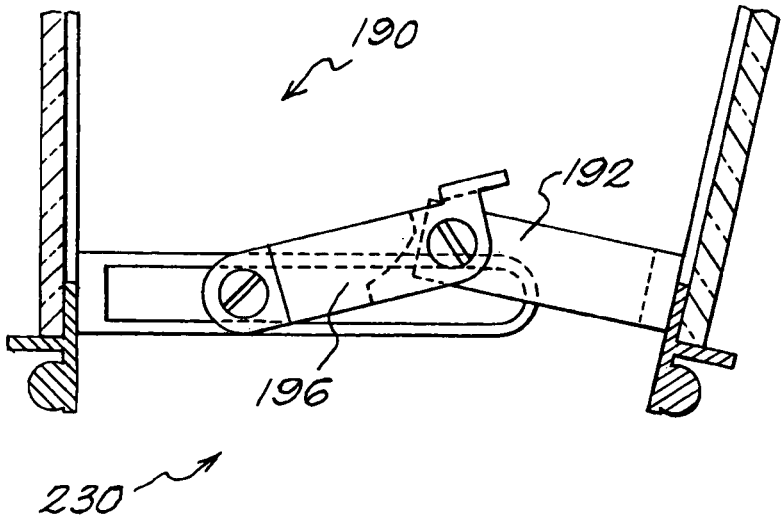
Figure 11C:
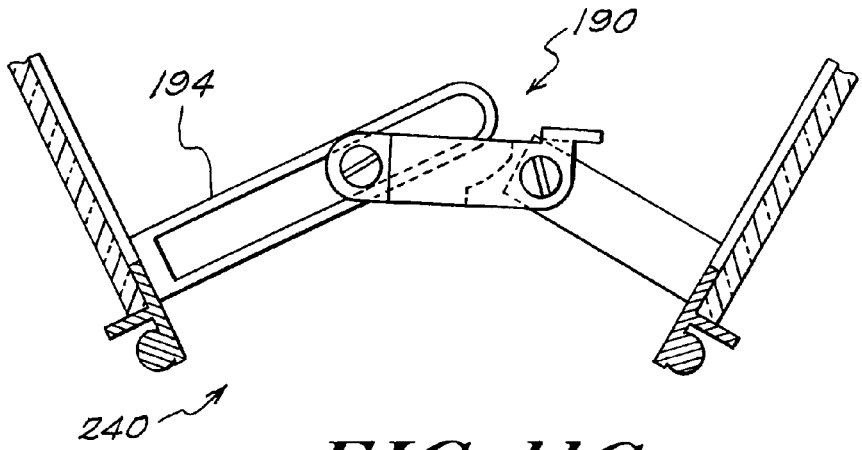
Figure 11D:
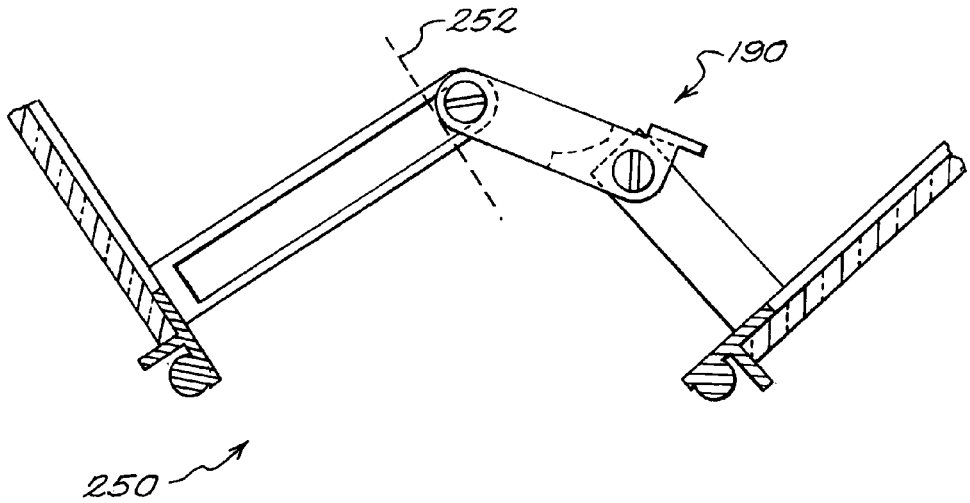
Figure 11E:
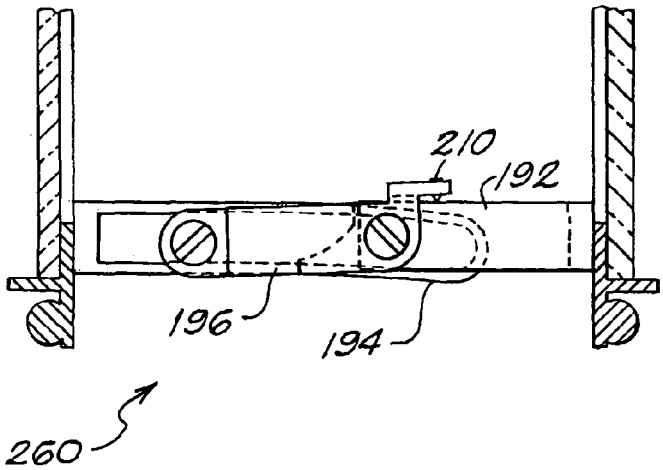

With reference now to FIG. 11, the operation of the interconnection hinge subassembly 190 will now be described. Generally designated at 220 in FIG. 11A is the state of the interconnection hinge subassembly 190 when the window module is closed and unlatched. Generally designated at 230 in FIG. 11B is the state of the interconnection hinge subassembly 190 when the inside window has been partially opened to the point when the arm of the member 192 (FIG. 10B) abuts the flange 206 (FIG. 10B) of the member 196 as schematically illustrated by arrows 208 (FIG. 10B). At that point, the U-shaped member 192 gangs the link member 196. After that point, the members 192, 196 move in unison about the pivot axis of the inside window. Generally designated at 240 in FIG. 11C is the state of the interconnection hinge subassembly 190 when the inside window has been opened beyond the point illustrated in FIG. 11B. With continued rotation beyond that point, a force is imparted to the slotted member 194 causing the outer window to pivot outwardly in concert therewith in a "butterfly" fashion; the motion continues until the hinge 190 is in the state generally designated 250 in FIG. 11D. As schematically illustrated by dashed line 252, the end of the slotted member may be made frangible, or another mechanism provided, to release the hinge 190 in emergency or other situations. To close the window module, the same process is repeated, but in reverse order, not separately described for the sake of brevity of explication. Generally designated at 260 in FIG. 11E is the state of the interconnection hinge subassembly 190 when the window module is closed and latched. As illustrated, the adjustable offset provided by the end of the screw 210 forces the slotted member downwardly, exaggerated in the drawing for the purposes of illustration, which rotates the outer window clockwise, firmly seating the outer window against weather-seals via compression and securely locking the same in its closed position. The outer sash is secured by the compression and the structural capacity of the interconnection hinge to hold it in place, and the inner window can be latched in a normal manner to prevent entry. Even if the outer window and hinges are compromised, the inner window would still be secure. Other mechanisms such as a security bolt could be employed to provide security of the outer window.

Many modifications and/or alternate embodiments of the frameless window module of the present invention will become apparent to those of skill in the art without departing from the inventive concepts.

What is claimed is:

1. A window module providing, in dependence on the number of modules arrayed, operable windows of any length in a wood stud frame wall having opposing interior and exterior faces and structural members including a top, longitudinally-extending cap piece, a longitudinally-extending sole plate and a continuous run of laterally-spaced, upstanding studs interconnecting the cap piece and sole plate, said window module eliminating both the need to cut any stud to provide a window box opening and the use of a window box installed in a window box opening, comprising:

first and second glazing member subassemblies;

first means coupled to said first glazing member subassembly for mounting said first glazing member subassembly exteriorly outwardly to at least one of said structural members of said wood stud frame wall without penetrating said wood stud frame wall at one of said opposing interior and exterior faces of said wood stud frame wall for pivoting motion between open and closed positions away from and towards said one of said opposing faces of said wood stud frame wall; and second means coupled to said second glazing member subassembly for mounting said second glazing member subassembly exteriorly outwardly to at least one of said structural members of said wood stud frame wall without penetrating said wood stud frame wall at the other of said opposing interior and exterior faces of said wood stud frame wall for pivoting motion between open and closed positions away from and towards said other one of said opposing faces of said wood stud frame wall, said first and second means thereby eliminating both the need to cut any said upstanding stud of said wood stud frame wall to provide a window box opening thereinthrough, and the use of a window box installed in the window box opening.

2. The window module of claim 1, wherein each of said first and second means respectively coupled to said first and second glazing member subassemblies includes a pivot hinge subassembly.

3. The window module of claim 2, wherein said pivot hinge subassembly is adapted for lift-off action allowing each said first and second glazing member subassembly to be readily installed to and removed from said opposing interior and exterior faces of said wood stud frame wall.

4. The window module of claim 1, wherein each of said first and second glazing member subassemblies has lateral and longitudinal edges; and further includes a seal and a seal-seat adapted to seal the lateral edges of each of said glazing member subassemblies, and a seal and a seal-seat adapted to seal the longitudinal edges of each of said glazing member subassemblies, when the glazing member subassemblies are in their closed positions.

5. The window module of claim 4, wherein each of said seals adapted to seal the longitudinal edges of each said glazing member subassembly when the subassemblies are in their closed positions is a pneumatic seal; and further including a gas manifold and controller operatively coupled to each said pneumatic seal for varying the degree of seal made by each said pneumatic seal to controllably provide one or more variable-insulation apertures when the glazing member subassemblies of one or more modules are in their closed positions.

6. The window module of claim 1, further including an interconnection hinge subassembly couplable to said first and second glazing member subassemblies responsive to the pivoting motion of one glazing member subassembly towards and away from the corresponding one of the interior and exterior faces of the wood stud frame wall to cause pivoting motion of the other glazing member subassembly towards and away from the other one of the opposing interior and exterior faces of the wood stud frame wall; whereby, the glazing member subassemblies of said window module move together in concert in a butterfly fashion between their open and closed positions.

7. The window module of claim 6, wherein said interconnection hinge subassembly couplable to said first and second glazing member subassemblies is adapted to vary the phase of glazing member subassembly closure such that one of the glazing member subassemblies is moved to its closed position before the other glazing member subassembly is moved to its closed position.

8. The window module of claim 6, wherein said interconnection hinge subassembly couplable to said first and second glazing member subassemblies is adapted to apply compressive force to at least one of said glazing member subassemblies when they are moved to their closed positions so as to clamp the glazing member subassemblies of said window module shut.

9. The window module of claim 1, wherein each said glazing member subassembly includes a first glass pane adhesively laminated in laterally offset relation to a second glass pane defining flanges to both sides thereof, and edge plates adhesively mounted to each of the flanges.

10. The window module of claim 1, wherein each said glazing member subassembly includes a single glass pane mounted in a generally rectangular casement, a generally rectangular sash adapted for exterior mounting outwardly to said at least one structural member at respective ones of said opposing interior and exterior faces, and at least one pivot subassembly pivotally connecting said casement and said sash.

11. A frameless integument module mountable to a wood stud frame wall without penetrating the wood stud frame wall having opposing interior and exterior faces and a continuous run of studs that does not compromise the studs' load bearing capability, comprising:

first and second integument members, said integument members each having lateral and longitudinal edges;

first and second means for exteriorly mounting said first and second members respectively outwardly at said opposing faces of the wood stud frame wall without penetrating the wood stud frame wall;

said first and second means respectively including first and second pivot hinge subassemblies respectively coupled to one of said lateral and longitudinal edges of each of said first and second integument members, each said first and second pivot hinge subassembly respectively coupled to said one of said lateral and longitudinal edges of each said first and second integument members is adapted to pivotally mount each said first and second integument members for motion between open and closed positions away from and towards respective ones of said interior and exterior faces of said wood stud frame wall; and at least one third interconnection hinge couplable to both said first and second integument members adapted to cause said first and second integument members to pivotally move together away from and towards respective ones of said exterior and interior faces of said wood stud frame wall in a butterfly fashion.

12. The frameless integument module of claim 11, wherein said integument members are transparent.

13. The frameless integument module of claim 11, wherein said one of said lateral and longitudinal edges of each said integument member is a lateral edge of each said integument member.

14. The frameless integument module of claim 11, wherein each said first and second pivot hinge subassembly is adapted for lift-off action allowing each said integument member subassembly to be readily installed and removed.

* * * * *